US011633742B2

(12) United States Patent
Layton

(10) Patent No.: US 11,633,742 B2
(45) Date of Patent: Apr. 25, 2023

(54) APPARATUS FOR PROVIDING A FOOD GRINDER SYSTEM USING ALTERNATIVE POWER SOURCES MOUNTED ON A SINGLE BASE

(71) Applicant: Mark L. Layton, Orem, UT (US)

(72) Inventor: Mark L. Layton, Orem, UT (US)

(73) Assignee: MLJMJ Holding Company, LLC, Provo, UT (US)

( * ) Notice: Subject to any disclaimer, the term of this patent is extended or adjusted under 35 U.S.C. 154(b) by 0 days.

(21) Appl. No.: 16/926,602

(22) Filed: Jul. 10, 2020

(65) Prior Publication Data

US 2022/0008929 A1 Jan. 13, 2022

(51) Int. Cl.

| | |
|---|---|
| ***B02C 1/00*** | (2006.01) |
| ***B02C 18/06*** | (2006.01) |
| ***B02C 18/26*** | (2006.01) |
| ***B02C 2/00*** | (2006.01) |
| ***B02C 18/24*** | (2006.01) |

(52) U.S. Cl.

CPC ..... *B02C 1/00* (2013.01); *B02C 18/06* (2013.01); *B02C 18/26* (2013.01); *B02C 2002/002* (2013.01); *B02C 2201/00* (2013.01)

(58) Field of Classification Search

CPC ..... B02C 18/38; B02C 18/06; B02C 18/26; B02C 1/00; B02C 4/42; B02C 7/16

USPC ..... 241/36

See application file for complete search history.

(56) References Cited

U.S. PATENT DOCUMENTS

| | | | | |
|---|---|---|---|---|
| 3,537,496 | A * | 11/1970 | Siegfried | B02C 18/06 241/89.4 |
| 5,872,413 | A * | 2/1999 | Magliari | B02C 18/38 310/83 |
| 8,690,092 | B2 | 4/2014 | Jenkins et al. | |
| 9,939,025 | B2 | 4/2018 | Palmer | |
| 2006/0016921 | A1 | 1/2006 | Vacha | |
| 2011/0284670 | A1* | 11/2011 | Jenkins | B02C 7/188 241/6 |
| 2013/0327867 | A1* | 12/2013 | Palmer | F16D 1/101 241/285.1 |

OTHER PUBLICATIONS

Pedal-Powered Drivetrain System (prior date Jun. 3, 2017), retrieved date Oct. 20, 2021.*

Bike-Powered Mill, retrieved date Jul. 31, 2022. https://inhabitat.com/the-oracle-beater-fuels-ghanaian-paper-production-with-invasive-plants-and-cycling/.*

Bicycle Power for the Country Living Grain Mill _ Sensible Survival, retrieved date Nov. 18, 2022.*

* cited by examiner

*Primary Examiner* — Matthew Katcoff

*Assistant Examiner* — Mohammed S. Alawadi

(74) *Attorney, Agent, or Firm* — Dentons Durham Jones Pinegar

(57) ABSTRACT

A food grinding system with alternative power sources, including a food grinder, an electrical power source, and a manual power source mounted to or otherwise carried by a common base.

18 Claims, 12 Drawing Sheets

APPARATUS FOR PROVIDING A FOOD GRINDER SYSTEM USING ALTERNATIVE POWER SOURCES MOUNTED ON A SINGLE BASE

TECHNICAL FIELD

This disclosure relates generally to apparatuses for providing alternative power sources to drive a food grinder. More specifically, this disclosure relates to apparatuses and processes for providing a grain grinder with alternative power sources, with the grain grinder and the alternative power sources mounted on a single base.

RELATED ART

There are many different types of grinders for foods, such as grains, including wheat, barley, oats, buckwheat, field corn, beans, and dried rice. Some grinders are electrically powered, whether by standard wall voltage or by battery. Other grinders are powered by hand, foot, or both. Electrically-powered grinders are often preferred because of the ease and continuity of operation. However, when an electrical source is not available, or an electric motor becomes inoperable, then a manually powered grinder is a necessity.

U.S. Pat. No. 8,690,092 (Jenkins et al.) discloses a nut grinder that includes an auger, a stationary grinding plate, and a rotatable grinding plate configured to grind nuts. The auger and rotatable grinding plate receive rotational power from a v-shaped pulley connected to a drive shaft. A belt connects the v-shaped pulley to a manually powered pulley or, alternately, to a separate motor.

U.S. Pat. No. 9,939,025 (Palmer) discloses a small grinding mill having a drive shaft coupling alternately connected to a hand crank for manual power or to the output shaft of a small motor for electrical power. The motor used in Palmer includes a support arm that presses against the motor housing to prevent the motor from moving or rotating while powering the drive shaft of the grinding mill.

Various other contraptions have been provided that connect a stationary bicycle, treadmill, exercise machine, or the like via a v-belt to a grinder pulley to provide manual power to a grinder in the event that a motor fails, for example, because of a power outage or damage to the motor. Many problems arise with such mechanical arrangements, such as providing and maintaining correct belt tension between the machine and the grinder, trying to prevent slippage of a belt connected to a pulley, v-belt turn-over in the pulleys because of improper installation, broken or worn-out belts, and, in the event of an electrical outage, struggling in the dark to locate and properly connect such mechanical devices to a grinder.

SUMMARY

An apparatus is provided in a unitary configuration of a food grinding system that includes a food grinder, a manual power source, and an electrical power source (e.g., an electric motor), wherein the food grinder, the manual power source (which may also be referred to as a "manually driven unit"), and the electrical power source are mounted on or otherwise carried by a single base.

In addition, a food grinding system is provided with a food grinder having a sprocket wheel for alternately connecting to a sprocket wheel on an electric motor or to a sprocket wheel on a manual power source, these components of the food grinding system being mounted on or otherwise carried by a common base.

Moreover, a food grinding system is provided with a food grinder having a grinder rotary mechanism thereon for alternately connecting to a motor rotary mechanism on an electric motor or to a manual rotary mechanism on a manual power source, these components of the food grinding system being mounted on or otherwise carried by a common base.

In addition, a food grinding system is provided for maintaining proper tension in the connections between components of the system (e.g., a food grinder and an electric motor or manual power source on the same base) and preventing slippage of the connections.

Other aspects of the disclosed subject matter, as well as features and advantages of various aspects of the disclosed subject matter, will become apparent to those of ordinary skill in the art through consideration of the ensuing disclosure, the accompanying drawings, and the appended claims.

In the following description, for purposes of explanation, numerous specific details are set forth in order to provide a thorough understanding of the disclosed apparatuses, systems, and methods. It will be apparent to one of ordinary skill in the art that the disclosed embodiments may be practiced without these specific details.

DETAILED DESCRIPTION

Reference in the specification to "an example" or similar language means that a particular feature, structure, or characteristic described in connection with the example is included in at least that one example, but not necessarily in other examples.

The following description provides examples or embodiments of new and useful apparatuses and processes for alternately connecting a food grinder to a manual power source and an electrical power source, both of which are mounted on or otherwise carried by the same base as the food grinder.

Figure 1:
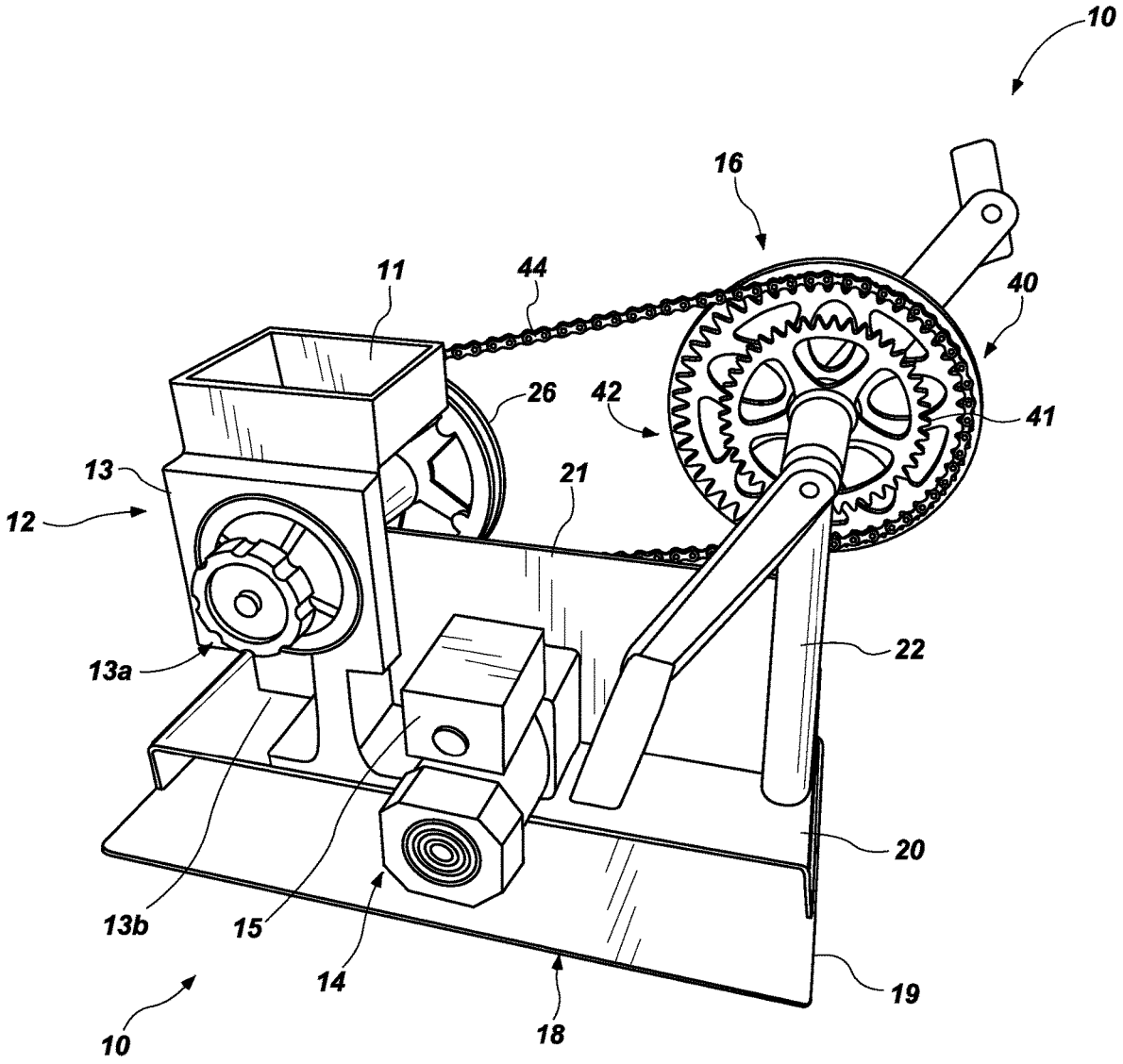
FIG. 1 is a perspective view of an embodiment of a food grinding system comprising a food grinder, an electric motor, and a manual power source, all mounted on or otherwise carried by a single base.

Referring to FIG. 1, a perspective view of a food grinding system 10 is shown with a food grinder 12, an electric motor 14, and a manual power source 16, which may be mounted on or otherwise carried by a common base 18. The base 18 comprises a raised horizontal platform 20 and a vertical plate 21.

The food grinder 12 may include a top receptacle 11 for receiving any type of grain or other food to be processed. A grinder unit 13 may be located below an opening of the top receptacle 11 and may contain suitable grinding equipment (not shown) for processing the food. The grinder unit 13 may include a grinder shaft assembly 13*a* protruding from the front and the back of the grinder unit 13. A front outlet 13*b* is also shown which may provide the resulting product of the grinding process.

The manual power source 16 may comprise a drive sprocket wheel 40 with an outer sprocket piece 42 connected to a grinder sprocket wheel 26 on the food grinder 12 via a chain 44. An inner sprocket piece 41 (e.g., a smaller sprocket, as depicted; a larger sprocket; etc.) may also be included on the wheel of the manual power source 16 to change the rotational ratio between the wheel of the manual power source 16 and the grinder sprocket wheel 26.

The electric motor 14 and food grinder 12 may be mounted on the vertical plate 21, which is situated on the raised horizontal platform 20 of the base 18, abutting the front side 21*a* of the vertical plate 21. The manual power source 16 may be mounted on a vertical post 22, which may be part of the vertical plate 21 or positioned adjacent to the vertical plate 21. A gear head reducer 15 may be mounted on the electric motor 14 for adapting the speed of the motor rotation to the speed needed for the motor shaft (not shown here) to rotate the grinder shaft (not shown here).

Figure 2:
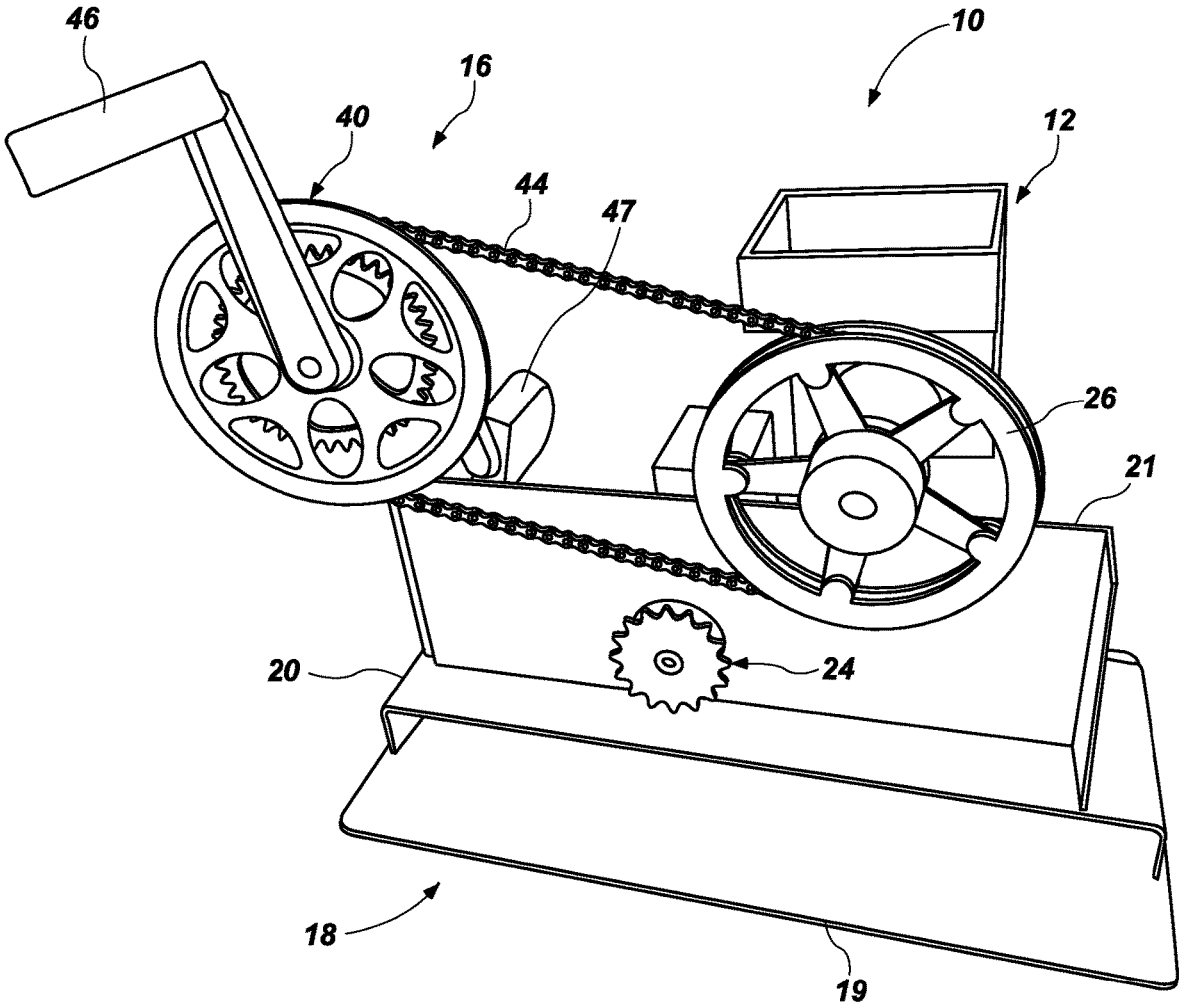
FIG. 2 is a close-up perspective view showing the use of the manual power source to operate the food grinding system of FIG. 1.

FIG. 2 provides a backside view of the food grinding system 10. The manual power source 16 may be a bicycle-like pedal system comprising at least the drive sprocket wheel 40 that may be rotatably attached to vertical post 22 shown in FIG. 1. As in FIG. 1, the manual power source 16 (including the drive sprocket wheel 40), the food grinder 12, and the electric motor 14 are mounted on a common base 18. The base 18 includes a horizontal platform 19, a raised horizontal platform 20, and a vertical plate 21.

The drive sprocket wheel 40 may be connected to the food grinder 12 by chain 44 to supply power to operate the food grinder 12. The drive sprocket wheel 40 may include an outer sprocket piece 42 (shown in FIG. 1) with teeth 41 around an outer edge thereof for engaging a chain 44. The chain 44 may also be engaged by teeth on the grinder sprocket wheel 26 to operatively couple the drive sprocket wheel 40 of the manual power source 16 to the grinder sprocket wheel 26. At least one crank and a corresponding first pedal 46 may be rotatably connected to the drive sprocket wheel 40 for manually rotating the drive sprocket wheel 40. A second crank and corresponding second pedal 47 may also be rotatably connected to the drive sprocket wheel 40, which may assist in rotating the drive sprocket wheel 40.

The first pedal 46 and second pedal 47 may be manually rotated by hands or feet, as desired. If rotated by feet, a conventional seat or stool (not shown) may be provided for the convenience of the person providing the manual rotation. It should be understood that the pedal system described in FIGS. 1 and 2 is only one embodiment of a manual power source 16, which may be any manually operated system that can provide mechanical power to the food grinder 12.

Figure 3:
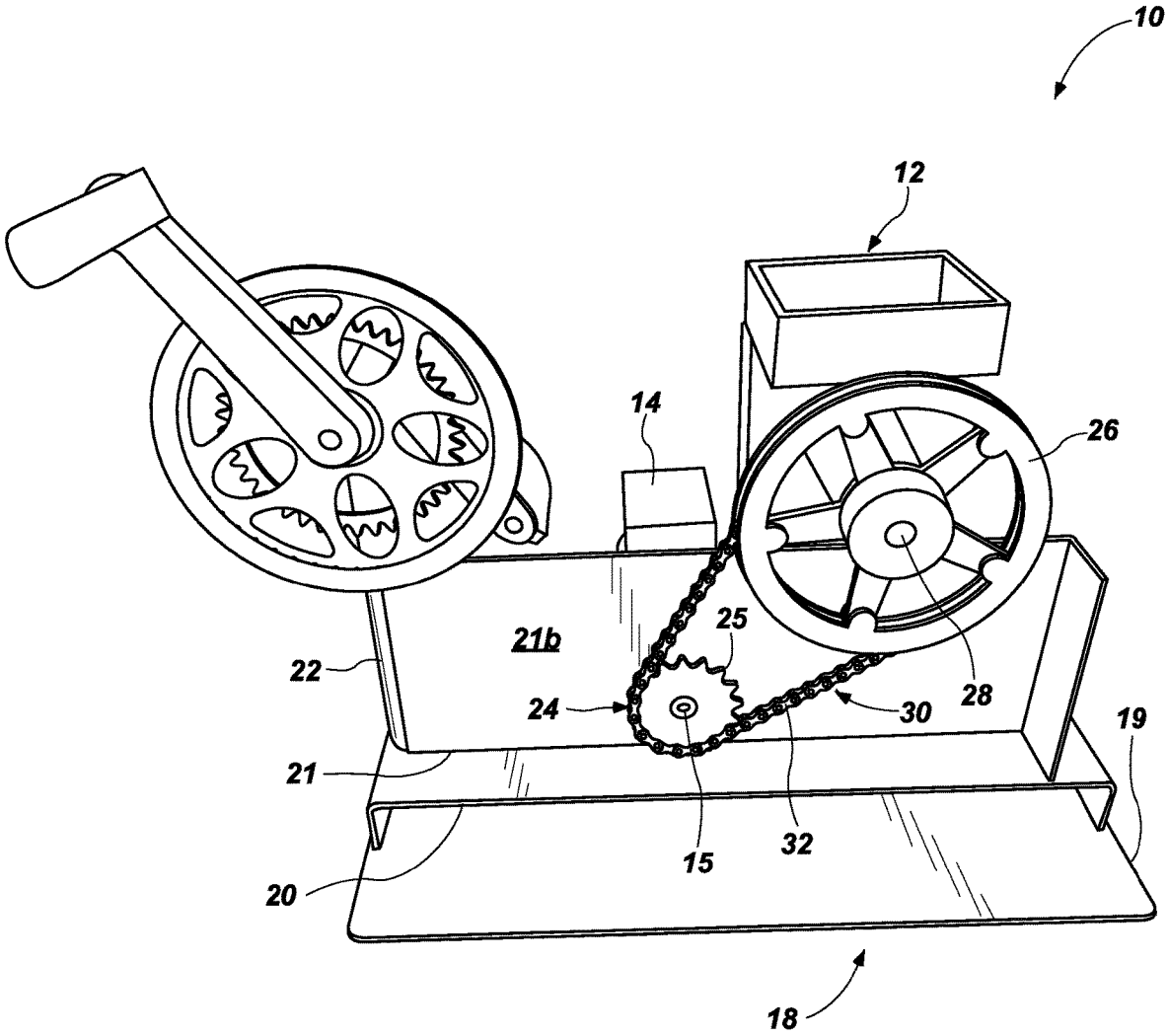
FIG. 3 is a perspective view of the food grinding system shown in FIG. 1, wherein a sprocket wheel of the electric motor is connected to a sprocket wheel of the food grinder for electrical operation.
Figure 4:
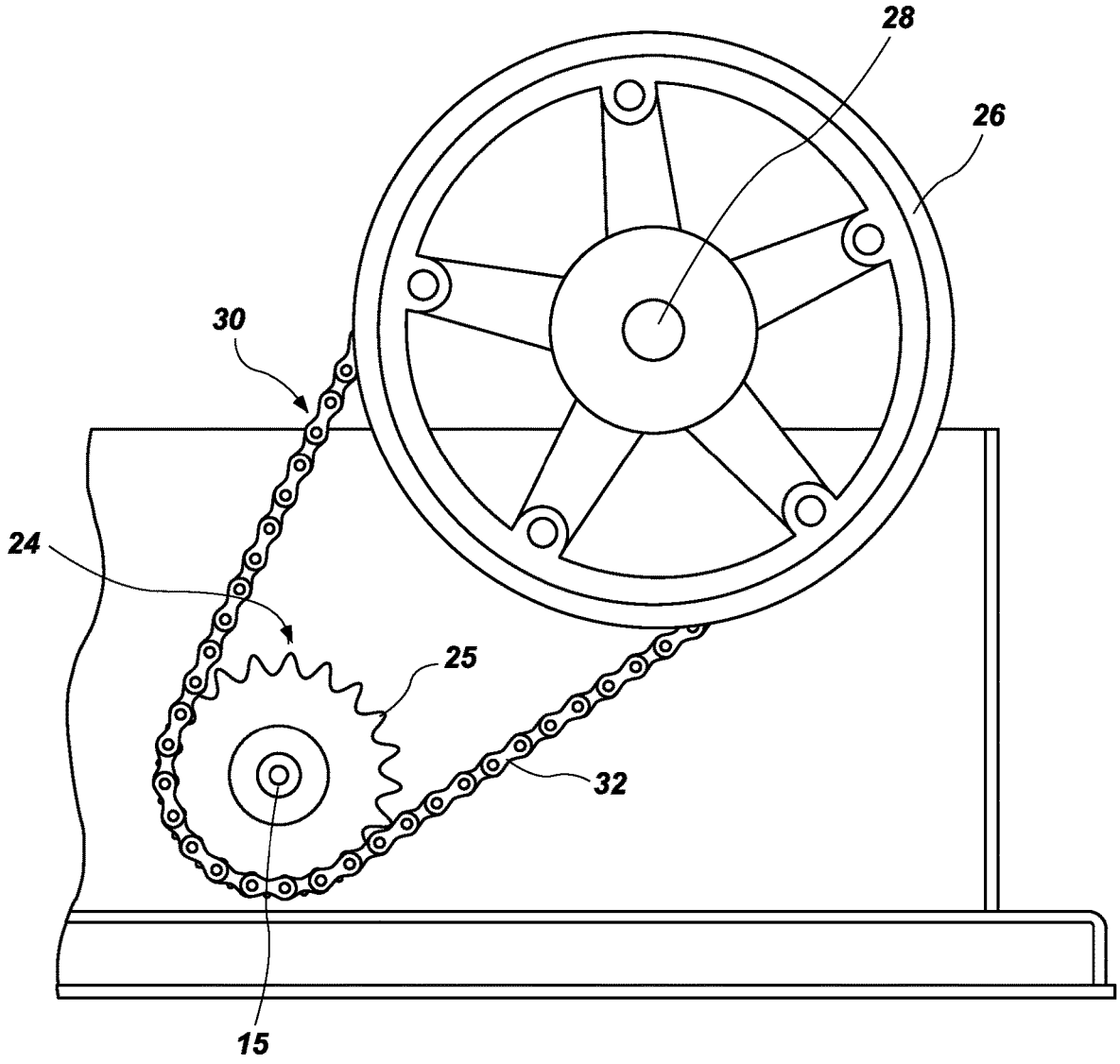
FIG. 4 is a close-up perspective view of the food grinding system shown in FIG. 3.

Looking next at FIGS. 3 and 4, an embodiment is shown in which the electric motor 14 is connected to the food grinder 12 to supply power to operate the food grinder 12. The back side 21*b* of the vertical plate 21 is shown, through which the shaft 15 of the electric motor 14 may extend. A motor sprocket wheel 24 may be secured to shaft 15 that may enable rotation with the same or similar speed as shaft 15. The motor sprocket wheel 24 may have evenly spaced teeth 25 around its perimeter. A larger grinder sprocket wheel 26 may be affixed to a shaft 28 that may extend from the food grinder 12. The grinder sprocket wheel 26 also may have evenly spaced teeth 27 (not shown) around its perimeter.

The diameters of the motor sprocket wheel 24 and the grinder sprocket wheel 26 may be sized to a desired ratio that may enable the proper translation of rotation from the motor sprocket wheel 24 to the grinder sprocket wheel 26. In one embodiment of the description the ratio of the motor sprocket wheel 24 to the grinder sprocket wheel 26 may about 1 to 2, that is, by way of example, twenty (20) teeth on the motor sprocket wheel 24 and forty (40) teeth on the grinder sprocket wheel 29. However, any other useful ratio may be used.

A chain 30 may be connected between the motor sprocket wheel 26 and the grinder sprocket wheel 26. The chain 30 may comprise a plurality of links 32 that may include openings (not shown). The openings may be large enough to accommodate the teeth 25 of the motor sprocket wheel 24 and the teeth (not shown) of the grinder sprocket wheel 26.

It should be understood that the electric motor 14 may be of the type that can be connected to any available power source, such as a 110 V alternating current (AC) power supply, a 240 V AC power supply, or one or more batteries, including using a transformer, as needed. Moreover, the power source may be from a capacitor or other power storage device that may derive its power from a natural energy source, such as solar panels, wind, or fluid powered devices.

The motor sprocket wheel 24, the grinder sprocket wheel 26, and the drive sprocket wheel 40 may be any type of rotatable unit having conventional apparatuses thereon adapted to move a chain, belt, or other linkage having conventional apparatus thereon to accept the conventional apparatus of the rotatable unit.

Figure 5A:
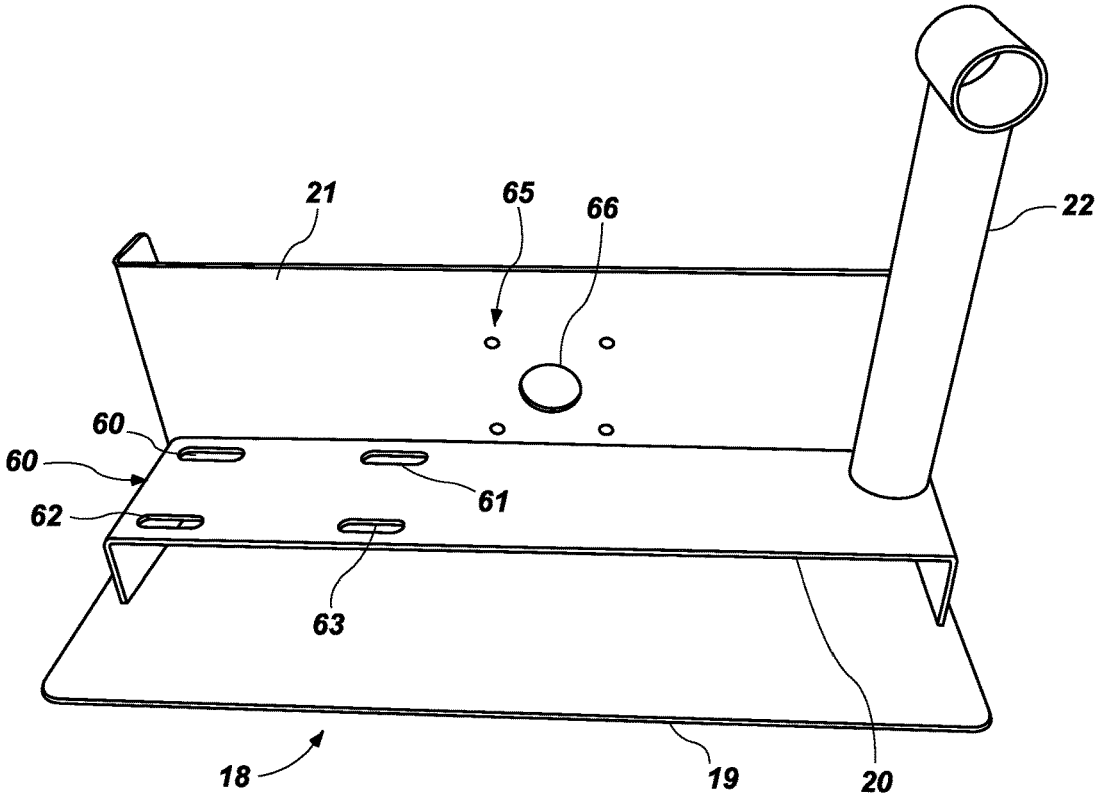
FIG. 5A is a perspective view of the base and raised platform for the embodiment of food grinding system shown in FIGS. 1-4.

Referring to FIG. 5A, a base 18 is shown that may be used to support the components of the embodiment of food grinding system 10 shown in FIGS. 1-4. A raised horizontal platform 20 is shown extending across most of a horizontal platform 19 and having four slots 60, 61, 62, and 63 where the food grinder 12, shown in FIGS. 1-4, may be mounted by four bolts (not shown). Each of the four bolts may extend through one of the four slots 60-63. This arrangement may enable horizontal movement of the food grinder 12 relative to the electric motor 14 (FIG. 1) and/or the manual power source 16 (FIG. 1) to change the tensions in the related chains. Holes 65 and 66 are shown in the vertical plate 21 of the base 18, through which a portion of the electric motor 14 may extend and be secured. A vertical post 22 is provided for support of the manual power source 16 or a portion of the manual power source 16.

Figure 5B:
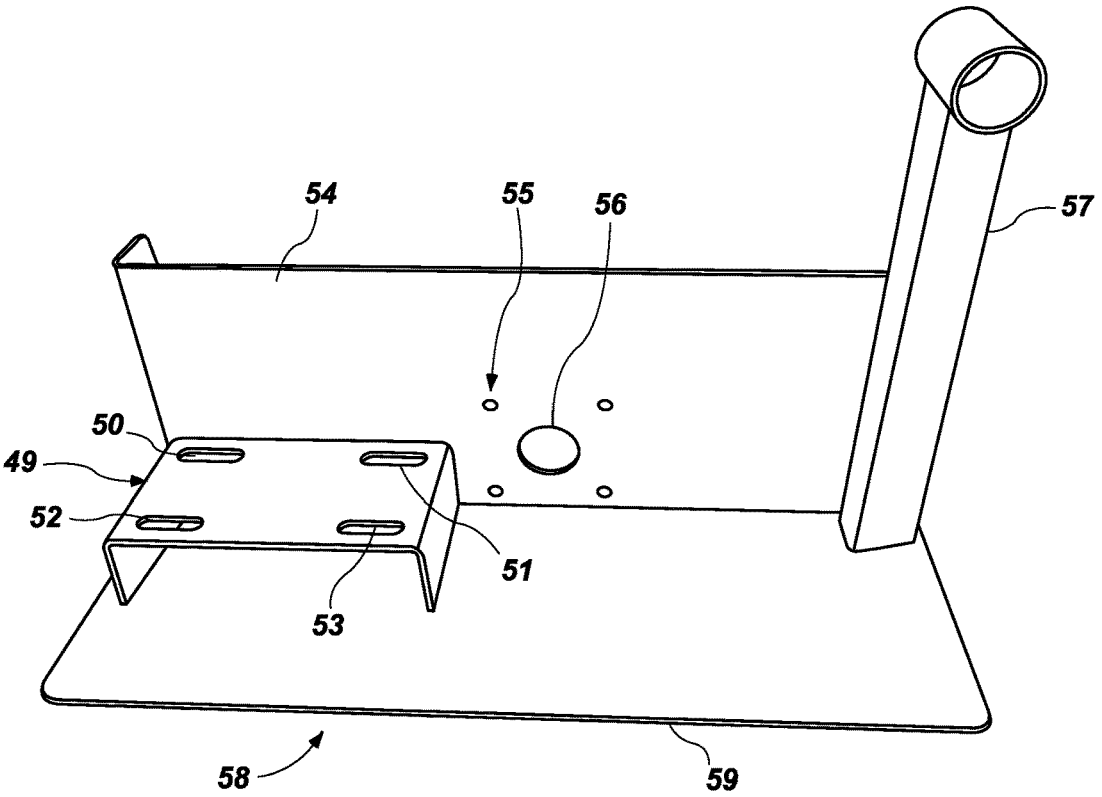
FIG. 5B is a perspective view of the base and raised platform for the embodiment of food grinding system shown in FIGS. 6, 7, 10, and 11.

As an alternative embodiment, FIG. 5B shows a base 58 with a raised horizontal portion 49 extending over a substantially lesser portion of a horizontal platform 59 and having four slots 50, 51, 52, and 53 where the food grinder 12, shown in FIGS. 6, 7, 10 and 11, may be mounted by four bolts (not shown). Each of the four bolts may extend through one of the four slots 50-53. As in FIG. 5A, this arrangement may enable horizontal movement of the food grinder 12 relative to the electric motor 14 (FIG. 1) and/or the manual power source 16 (FIG. 1) to change the tensions on the related chains. Holes 55 and 56 are shown in a vertical panel 54 through which a portion of the electric motor 14 may extend and be secured. A vertical post 57 is provided for support of the manual power source 16 or a portion of the manual power source 16.

Figure 6:
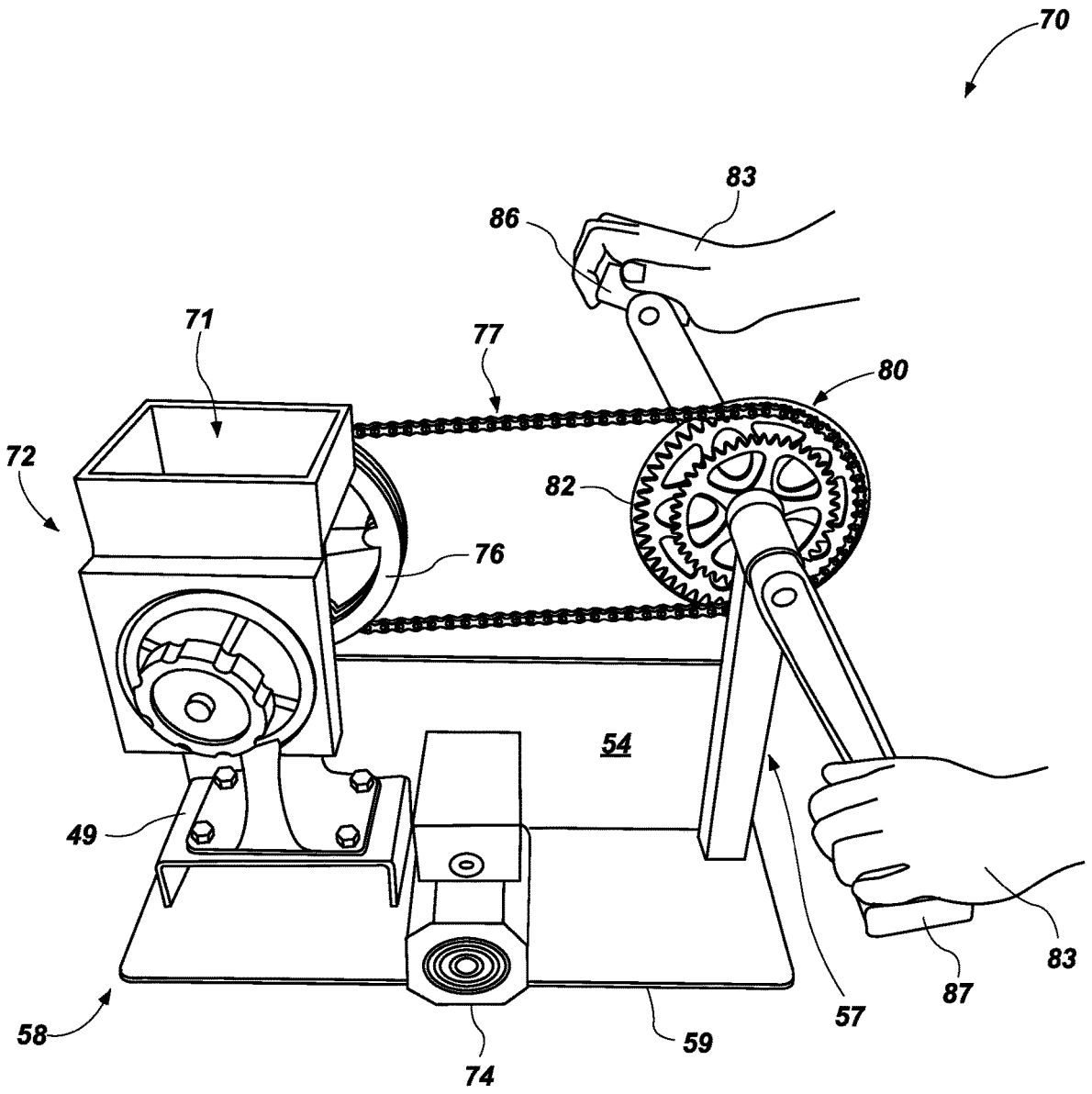
FIG. 6 is a perspective view of another embodiment of a food grinding system that includes a food grinder, an electric motor, and a manual power source, all carried by a single base, with the manual power source being operated by hand.
Figure 7:
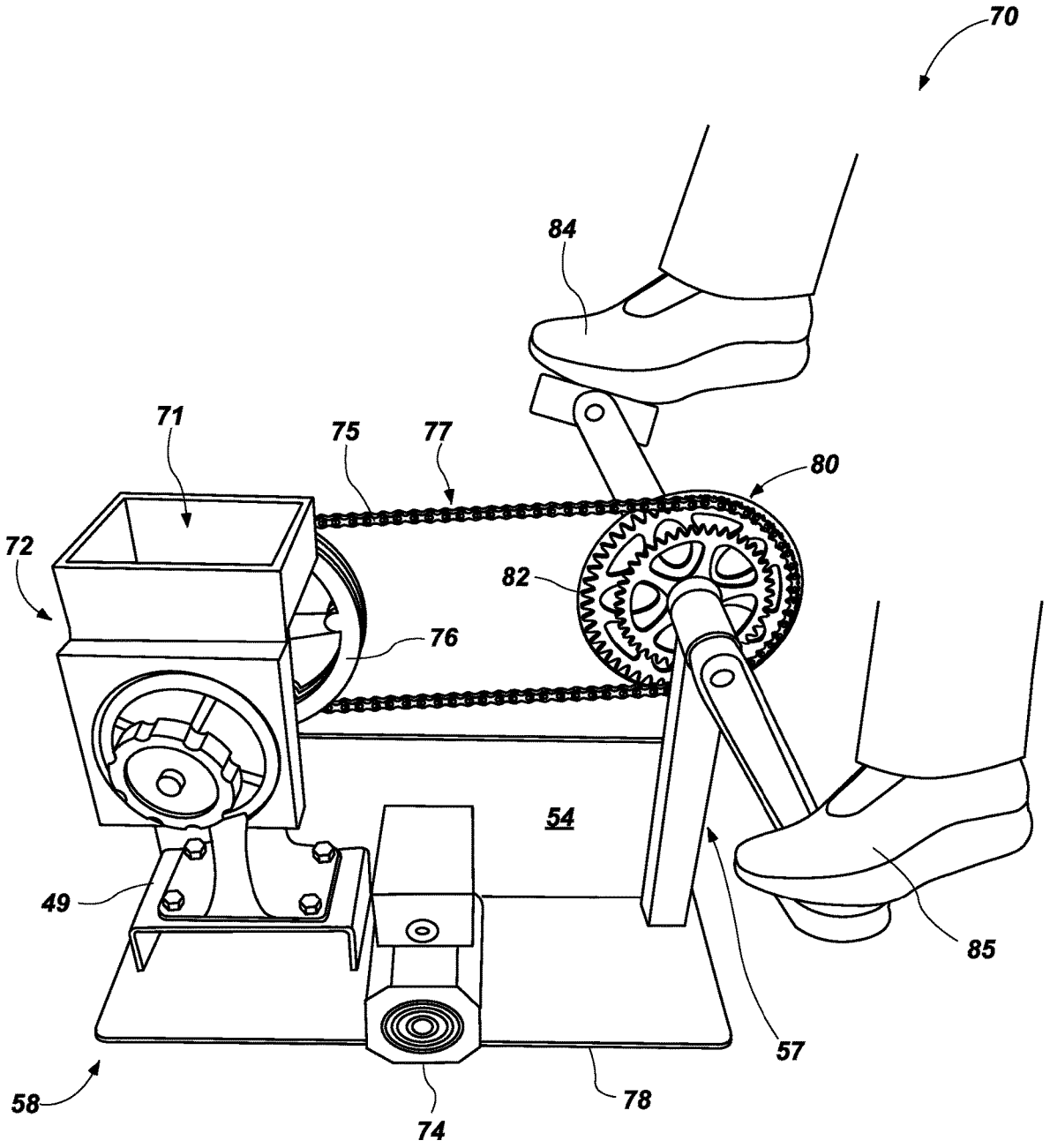
FIG. 7 is a perspective view of the food grinding system shown in FIG. 6, wherein the manual power source operated by foot.

Looking next at FIGS. 6 and 7, a food grinding system 70 is shown in manual powered mode having a raised horizontal portion 49 mounted on the horizontal platform 59. In FIG. 6, the manual power source may be one or more hands 83 on handles or pedals 86 and/or 87. As previously discussed, the handles or pedals 86 and/or 87 may be attached to a drive sprocket wheel 80 that may be rotatably attached to the vertical shaft 57. The drive sprocket wheel 80 may have teeth 82 around its perimeter for engaging a chain 77 that may be connected to the grinder sprocket wheel 76.

Referring to FIG. 7, the food grinding system 70 may be also manually powered by one or more feet 84 and/or 85 on handles or pedals 86 and/or 87. Otherwise the good grinding system 70 shown in FIG. 6 works the same as the food grinding system 70 shown in FIG. 7.

The food grinders 12 (FIG. 1) and 72 (FIGS. 6 and 7) shown herein may be conventional grinders, such as the types used for grinding various kinds of grains. An example of one type of food grinder 12, 72 may be a conventional grinder referred to as the Country Living Grain Mill, made by Country Living, 14727, 56$^{th}$ Avenue NW, Stanwood, Wash. 98292.

The electric motors 14 (FIG. 1) and 74 (FIGS. 6 and 7) shown herein may be conventional motors, such as the types used for grinding various kinds of grains. An example of one type of a conventional motor is model 5IKL90GE-FCH that may be sold by Oriental Motor USA of 570 Alaska Avenue, Torrance, Calif. 90503. The gear head reducer 15 may also be sold by Oriental Motor USA as model number 5GE15SA.

The drive sprocket wheels 40 (FIG. 2) and 80 (FIGS. 6 and 7) shown herein may be available as Shimano part FC-M311, sold by Jensen USA, 1615 Eastridge Avenue, Riverside, Calif. 92507. The grinder sprocket wheels 26 (FIG. 2) and 76 (FIGS. 6 and 7) may also comprise sprockets available from Shimano and sold by Jensen USA. The chains 44 (FIG. 2) and 77 (FIGS. 6 and 7) may be SRAM model PC830 chains. The crankshaft may be Shimano part UN55. Both may also be obtained from Jenson USA.

A conventional rubber base (not shown) may be placed beneath the horizontal platforms 19 (FIG. 2) and 59 (FIGS. 6 and 7) shown herein to reduce slippage of the food grinding system 10 (FIGS. 1-4) and 70 (FIGS. 6 and 7) and to isolate the vibrations generated by the food grinding system.

Figure 8:
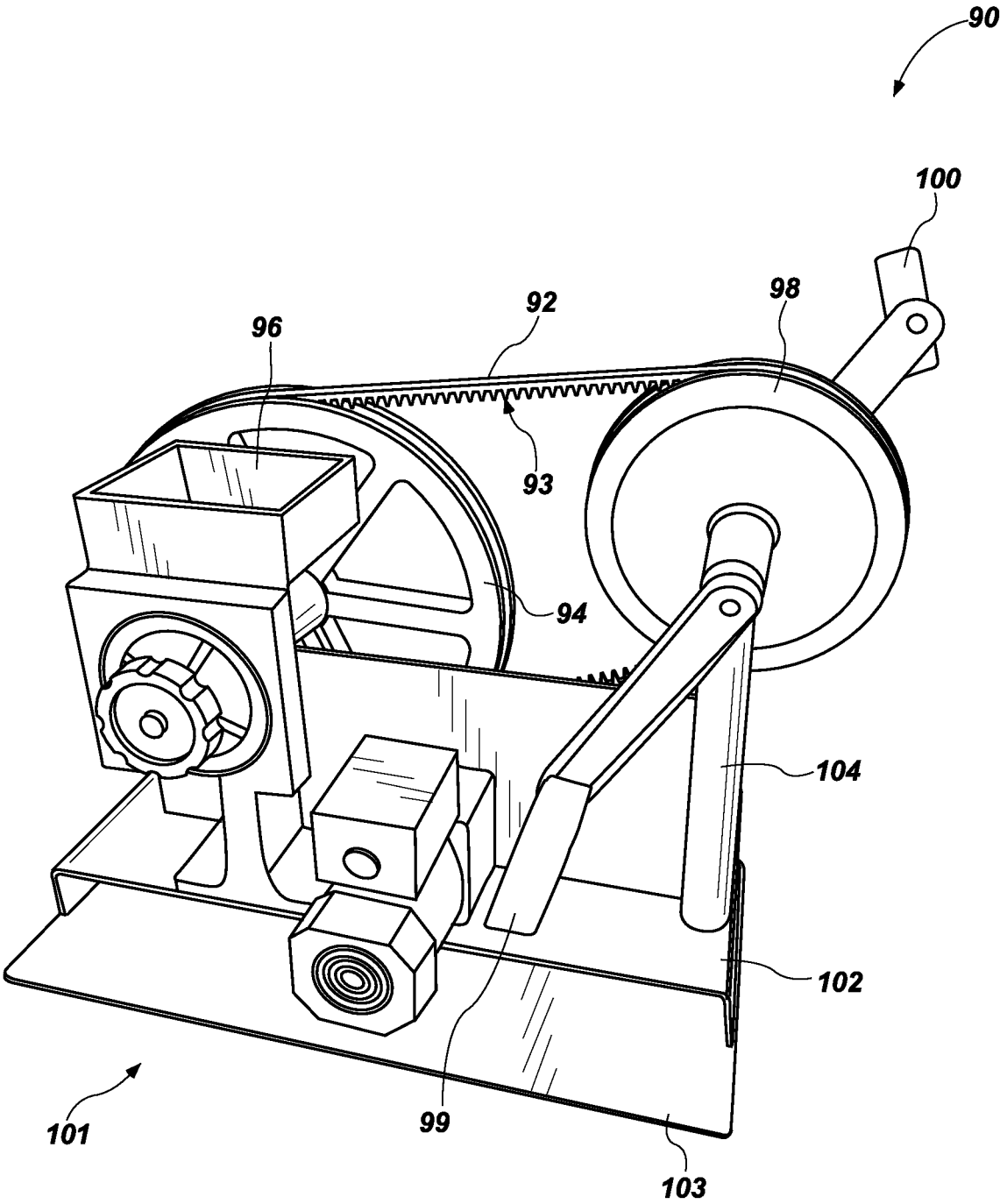
FIG. 8 is a perspective view of another embodiment of a food grinding system that includes a food grinder, an electric motor, and a manual power source, all carried by a single base, wherein the manual power source includes a belt power output wheel connected by a belt to a belt power input wheel of the food grinder.
Figure 9:
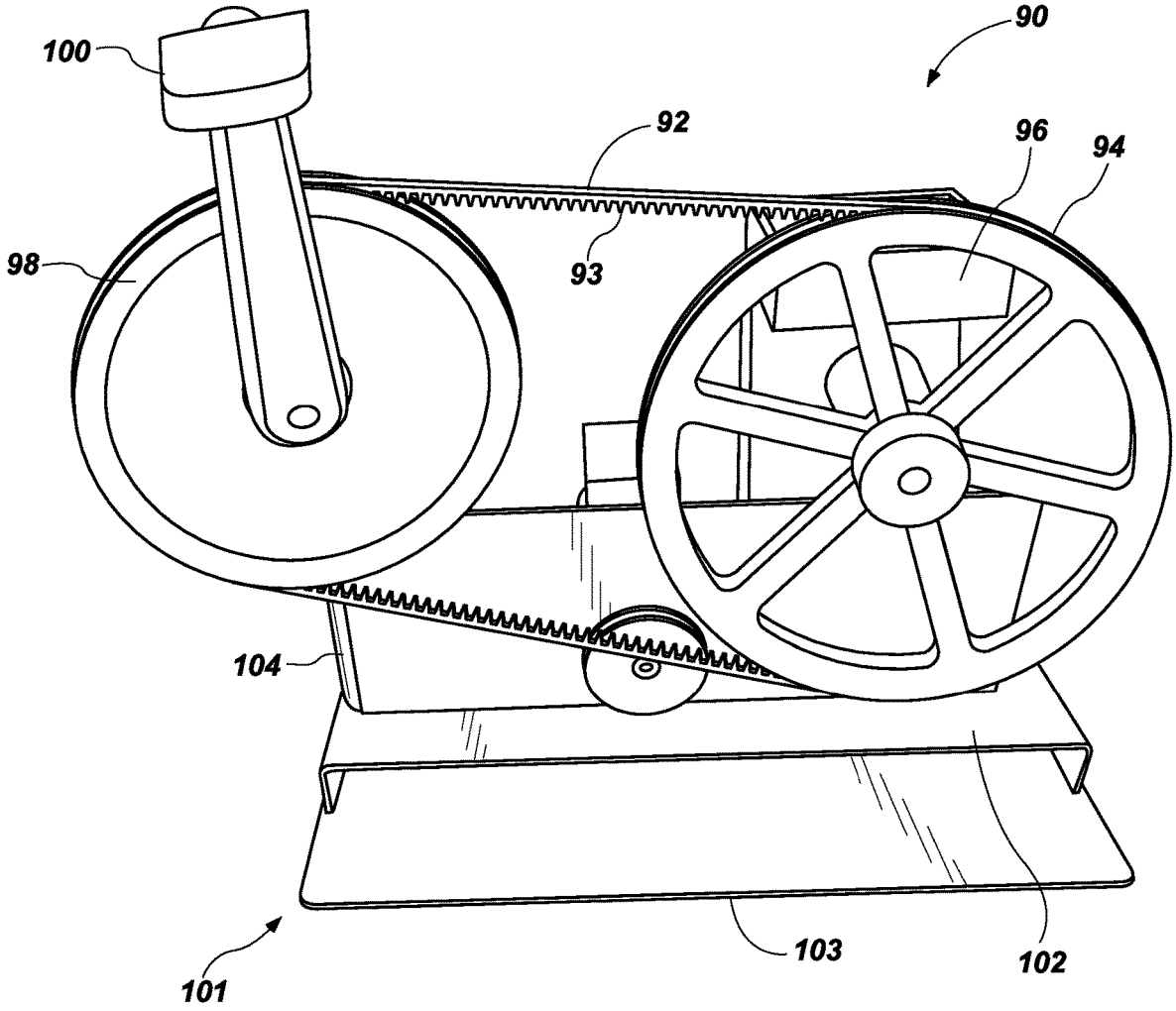
FIG. 9 is another perspective view of the embodiment of food grinding system shown in FIG. 8, shown from an opposite side of the food grinding system.

Another embodiment of food grinding system 90 is shown in FIGS. 8 and 9. In this embodiment, the sprocket wheels with teeth shown in previous drawings have been replaced with belt driven wheels, each having a channel for containing a belt connecting the power supply to the food grinder 12 (FIG. 1). Moreover, the chains shown in FIGS. 1-4, 6, and 7 may be replaced by belts. The belts may have various shapes, including without limitation a v-shaped cross section, referred to herein as a "v-belt." The electric motor 14 (FIG. 1), the manual power source 16 (FIG. 1) and the food grinder 12, all mounted on a single or common base 101, which may remain the same as the bases 18 and 58 shown in FIGS. 1-5B and 6 and 7, respectively.

Specifically, referring to FIGS. 8 and 9, another embodiment 90 is shown in which a conventional v-belt 92, having a conventional v-shaped profile, may be used instead of a chain. A v-belt grinder wheel 94 that may have a conventional v-shaped profile to accommodate the v-belt 92 for connection to a food grinder 96. Manual power may be provided by a v-belt drive wheel 98 having a conventional v-shaped profile to accommodate the v-belt 92. The v-belt drive wheel 98 may move under power provided through pedals 99 and 100.

The food grinder 96 may be mounted to a raised platform 102, which may in turn be mounted to a horizontal platform 103. The v-belt drive wheel 98 may be mounted on a vertical pole 104, the vertical pole 104 being also mounted to the raised platform 102 or extend from the horizontal platform 103 and through the raised platform 102.

In this embodiment, power may be supplied from the pedals 99 and 100 to the v-belt drive wheel 98 and through the v-belt 92, which may rotate the v-belt grinder wheel 94. The v-belt 92 may have conventional cogged wedges 93, such as an XPA cogged wedge v-belt, for added traction in the v-belt grinder wheel 94 and the v-belt drive wheel 98. The v-belt grinder wheel 94, the v-belt drive wheel 98, and the v-belt 92 are all conventional and may be obtained on the open market.

It should be understood that the scope of the present disclosure is meant to include any type of conventional belt, rope, cable, or other connector that may be used to connect the drive wheels or pulleys of the electric motor 14 (FIG. 1) and/or the drive wheels or pulleys of the manual power source 16 (FIG. 1) to the grinder wheels or pulleys on the food grinder 12 (FIG. 1).

Figure 10:
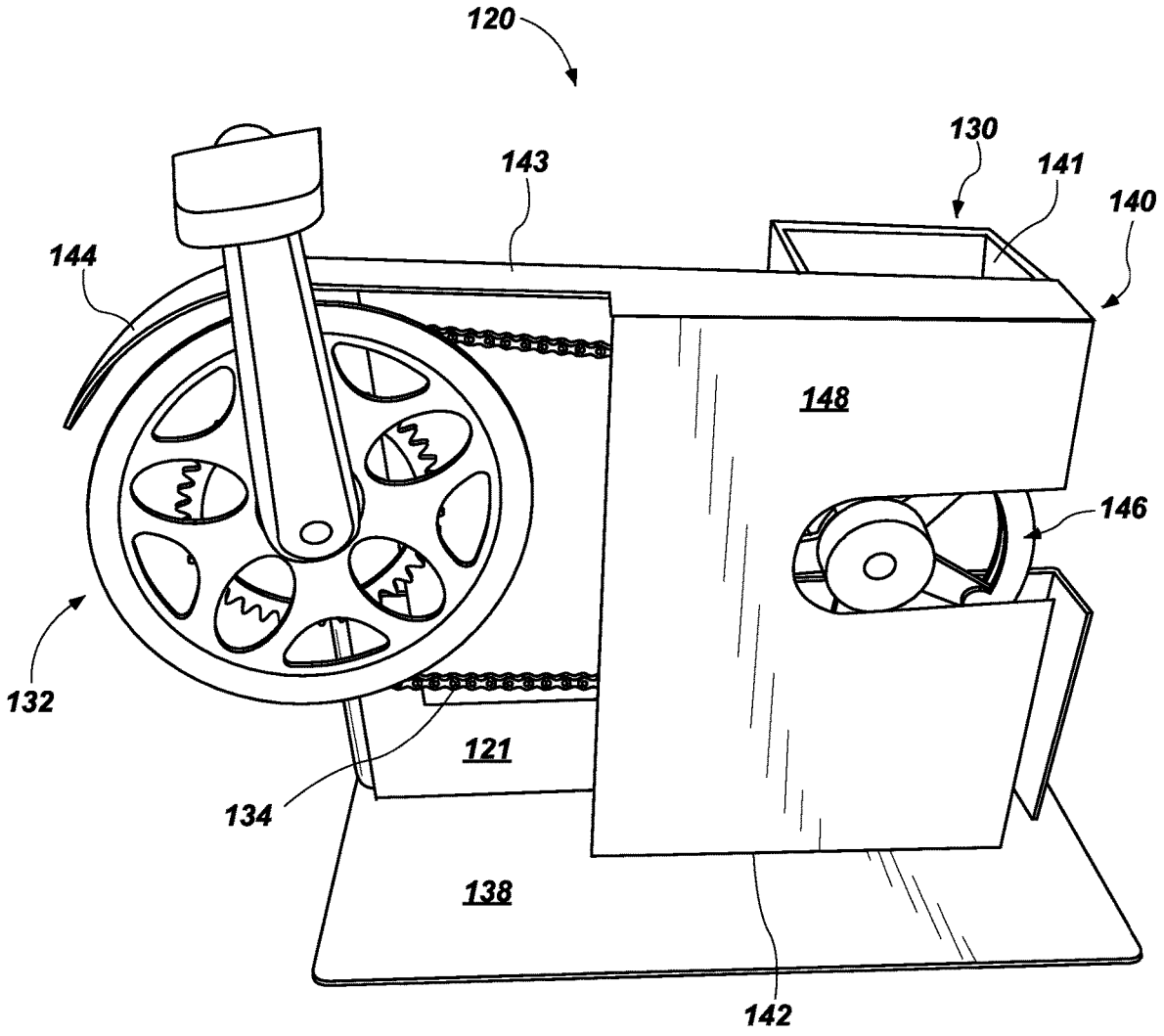
FIG. 10 is a perspective view of a food grinding system similar to the food grinding system shown in FIGS. 6 and 7, additionally comprising a chain guard covering part of a chain that operatively couples two sprockets as a safety feature.
Figure 11:
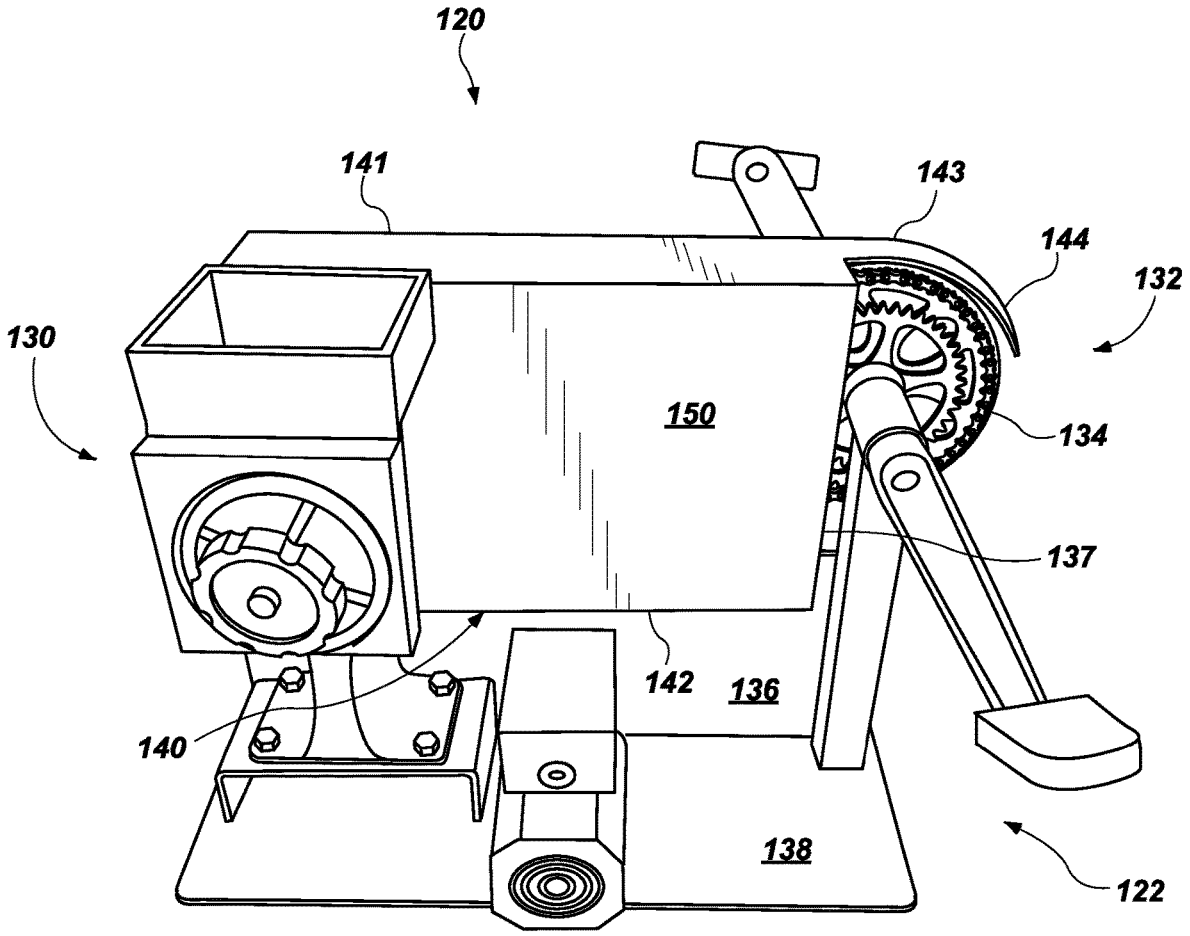
FIG. 11 is another perspective view of the food grinding system of FIG. 10, shown from the opposite side of the food grinding system.

Referring now to FIGS. 10 and 11, an embodiment of a food grinding system 120 is shown that is similar to the embodiment of food grinding system 70 shown in FIGS. 6 and 7, wherein a guard 140 has been added as a safety feature. In FIG. 10, the food grinding system 120 is shown from the back side of the vertical panel 121, showing a food grinder 130 connected to a manual power supply 132 by a chain 134. A back side 148 of the guard 140 has been placed over most of the chain 134 to protect users from contacting and being inadvertently caught up in the chain 134 or a belt. The guard 140 extends downward vertically so that the bottom 142 of the guard 140 rests on the base 138. The chain 134 extends to a grinder wheel 146 of the food grinder 130.

As seen in FIGS. 10 and 11, a top portion 141 of the guard 140 may include an extension 143 that may curve in a lip 144 to provide additional protective shielding over the chain 134 or a belt.

Looking at FIG. 11, the food grinding system 120 is shown from its front side 122, similar to FIG. 1. A vertical wall 136 extends upward from a base 138. The bottom 142 of the front part 150 of the guard 140 rests on the top 137 of the vertical wall 136 in a manner that stabilizes the guard 140, as better seen in FIGS. 12 and 13.

Figure 12:
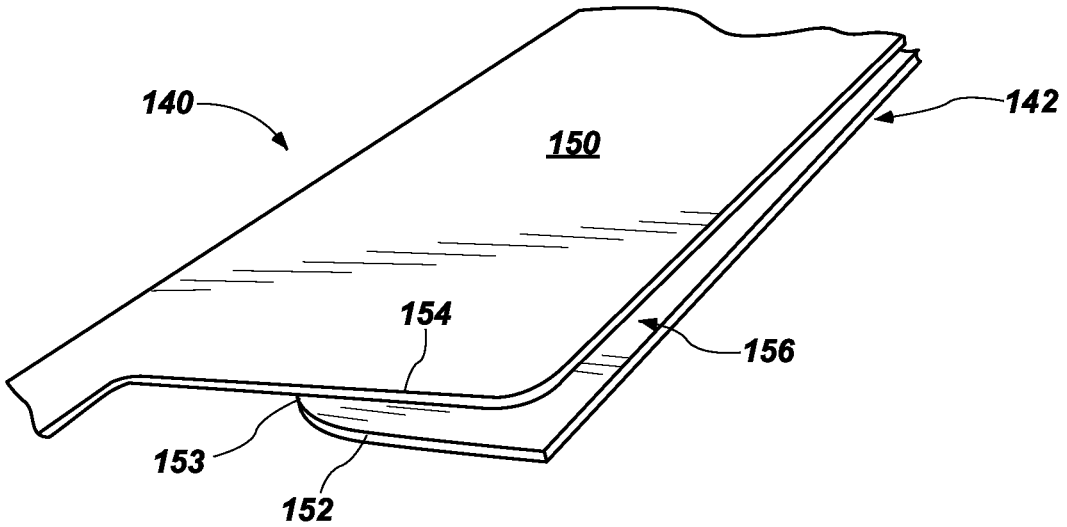
FIGS. 12 and 13 are close-up views of a portion of the chain guard shown in FIGS. 10 and 11.
Figure 13:
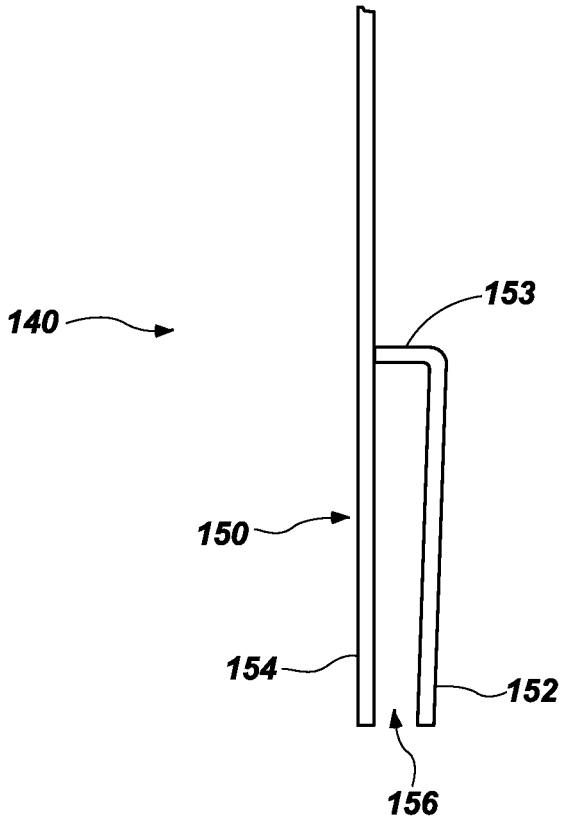

Referring now to FIGS. 12 and 13, a bottom 142 of the front part 150 of the guard 140 shown in FIGS. 10 and 11 is shown in more detail. In FIG. 12, the bottom 142 of the guard 140 includes two flat portions 152 and 154 that are oriented parallel to each other, resulting in a slot 156 shown in FIG. 13 in the bottom 142 of the front part 150 of the guard 140. As seen in FIG. 13, the slot 156 is sized so that the top (not shown) of the vertical wall 136 shown in FIG. 11 may fit into the slot 156 to enable the front part 150 of the guard 140 to be secured to the vertical wall 136.

The guard 140 may similarly be used with the electrically-driven portion of the embodiment of the food grinding system 10 shown in FIGS. 3 and 4 to protect a user from being damaged by the chain.

The guard 140 may similarly be used with the v-belt embodiment of the food grinding system 10 depicted by FIGS. 8 and 9, as well as other similar embodiments.

Although not shown here, the same v-belt pulleys connected by a common v-belt may be used to transmit power from an electric motor having a v-belt pulley output to a v-belt pulley mounted on a food grinder, in a manner similar to the sprocket embodiment.

Although various embodiments are shown having capability of transmitting manual or electrical power to a food grinder, it should be understood that other types of power transmission devices may be use for the same purpose. For example, other sprocket and chain driven devices may be used with sprocket connectors to transmit power from electric or manual power sources to a food grinder. Likewise other types and shapes of pulleys and belts may be used instead of v-belt pulleys and v-belts or sprocket wheels and sprocket chains.

One advantage of the present embodiments is that all components of the food grinding system may be mounted to or otherwise carried by the same base and are thereby readily available in case of an emergency. This is particularly advantageous when the normal house power supply goes out and manual operation is essential. In such case, it is likely that lighting may be very limited, so having all the components of the food grind system mounted on one platform eliminates the possibility of having to search in the dark for missing components.

Another advantage for one of the present embodiments is the use of sprockets and interlocking chains to eliminate slippage in the connections between the food grinder and the power supplies.

Another advantage for one of the present embodiments is that the use of chains having interlocking links instead of the use of belts, thereby reducing belt wear, twisting and breakage.

Yet another advantage of the present embodiments is the option of adjusting the distance from the food grinder to the electric or manual power supplies, to thereby adjust tension on the connecting chains as desired.

Still another advantage of the present embodiments is the option of applying either hand enabled power or foot enabled power to the manual power source.

Yet another advantage is to provide a belt and pulleys to provide manual and electrical power to the grinder.

Yet another advantage is to provide a cogged v-belt for added traction in v-belt pulleys.

Yet another advantage of the present embodiments is the use of conventional components that can easily be replaced as needed.

Another advantage of the present embodiments is the use of a chain or belt guard to protect against inadvertent harm to a user caused by contact with the chain or belt.

Although the preceding disclosure provides many specifics, these are merely examples and should not be construed as limiting the scope of any of the ensuing claims. Other embodiments may be devised which do not depart from the scopes of the claims. Features from different embodiments may be employed in combination. The scope of each claim is, therefore, indicated and limited only by its plain language and the full scope of available legal equivalents to its elements.

What is claimed:

1. A food grinding system having alternative power sources, comprising:

a base;

a food grinder;

a food grinder drive wheel that, when rotated, operates the food grinder;

a first power source;

a first power wheel that rotates upon operation of the first power source;

a second power source;

a second power wheel that rotates upon operation of the second power source; and a belt or a chain that couples with the food grinder drive wheel and one of the first power wheel and the second power wheel to enable selection between use of the first power source and the second power source to operate the food grinder, the base simultaneously carrying both the first power source and the second power source.

2. The food grinding system of claim 1, wherein the first power source is an electric motor.

3. The food grinding system of claim 1, wherein the second power source is a manual power source.

4. The food grinding system of claim 1, wherein the food grinder drive wheel, the first power wheel and the second power wheel comprise sprockets and the chain couples with the food grinder drive wheel and one of the first power wheel and the second power wheel.

5. The food grinding system of claim 1, wherein the food grinder drive wheel, the first power drive wheel, and the second power wheel comprise pulleys and the belt couples with the food grinder drive wheel and one of the first power wheel and the second power wheel.

6. The food grinding system of claim 1, wherein a position of the food grinder on the base is adjustable to change a first distance between the food grinder and the first power source.

7. The food grinding system of claim 6, wherein the position of the food grinder on the base is adjustable to change a second distance between the food grinder and the second power source.

8. The food grinding system of claim 1, wherein the second power source comprises one or more pedals.

9. A food grinding system with alternative power sources, comprising:

a base;

a food grinder;

a grinder drive wheel that rotates to operate the food grinder;

an electrically operated power source;

an electrical power wheel that rotates upon operating the electrically operated power source;

a manually operated power source;

a manual power wheel that rotates upon operating the manually operated power source; and a belt or a chain movable between the electrical power wheel and the manual power wheel to selectively link the electrical power wheel or the manual power wheel to the grinder drive wheel to provide power to the food grinder, the base simultaneously carrying both the electrically operated power source and the manually operated power source.

10. The food grinding system of claim 9, further comprising: a linkage guard positioned to protect against user contact with the belt or the chain.

11. The food grinding system of claim 9, wherein the electrically operated power source is an electric motor.

12. The food grinding system of claim 9, wherein the electrical power wheel comprises a motor power sprocket, the manual power wheel comprises a manual power sprocket, and the grinder drive wheel comprises a grinder sprocket.

13. The food grinding system of claim 12, wherein the chain includes a plurality of links, forms a closed loop, and is movable between the electrical power wheel and the manual power wheel.

14. The food grinding system of claim 9, wherein the manually operated power source comprises a manually operated pedal system.

15. The food grinding system of claim 9, wherein the electrical power wheel comprises an electrical power pulley, the manual power wheel comprises a manual power pulley, and the grinder drive wheel comprises a grinder drive pulley.

16. The food grinding system of claim 15, wherein the belt is movable between the electrical power wheel and the manual power wheel.

17. A food grinding system having alternative power sources, comprising:

a base;

a food grinder having a grinder drive wheel;

an electric motor having a motor power wheel adapted to selectively operative couple to the grinder drive wheel by a belt or a chain to provide power to the food grinder; and a manual rotary system having a manually operated power wheel adapted to selectively operatively couple to the grinder drive wheel by the belt or the chain to provide power to the food grinder when the motor power wheel of the electric motor is not operatively coupled to the grinder drive wheel of the food grinder, both the electric motor and the manual rotary system simultaneously disposed on the base.

18. The food grinding system of claim 17, wherein the manual rotary system includes pedals and cranks.

* * * * *